US010262784B2

(12) United States Patent
Cioffi et al.

(10) Patent No.: US 10,262,784 B2
(45) Date of Patent: Apr. 16, 2019

(54) CERAMIC INSULATED TRANSFORMER

(71) Applicant: General Electric Company, Schenectady, NY (US)

(72) Inventors: Philip Michael Cioffi, Schaghticoke, NY (US); Qin Chen, Schenectady, NY (US); Wei Zhang, Ballston Lake, NY (US); Ravisekhar Nadimpalli Raju, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 39 days.

(21) Appl. No.: 15/402,962

(22) Filed: Jan. 10, 2017

(65) Prior Publication Data

US 2018/0197669 A1 Jul. 12, 2018

(51) Int. Cl.

| | |
|---|---|
| ***H01F 27/02*** | (2006.01) |
| ***H01F 5/00*** | (2006.01) |
| ***H01F 41/12*** | (2006.01) |
| ***H01F 41/061*** | (2016.01) |
| ***H01F 41/02*** | (2006.01) |
| ***H01F 27/24*** | (2006.01) |
| ***H01F 27/32*** | (2006.01) |
| ***H01F 27/29*** | (2006.01) |

(52) U.S. Cl.

CPC ..... *H01F 27/02* (2013.01); *H01F 27/24* (2013.01); *H01F 27/29* (2013.01); *H01F 27/32* (2013.01); *H01F 41/0206* (2013.01); *H01F 41/061* (2016.01); *H01F 41/125* (2013.01)

(58) Field of Classification Search

USPC ..... 336/90

See application file for complete search history.

(56) References Cited

U.S. PATENT DOCUMENTS

| | | | | |
|---|---|---|---|---|
| 2,992,405 | A | 7/1961 | Ursch | |
| 3,659,240 | A | 4/1972 | Learned et al. | |
| 4,510,476 | A | 4/1985 | Clatterbuck et al. | |
| 4,855,552 | A | 8/1989 | Marceau | |
| 5,598,135 | A | 1/1997 | Maeda et al. | |
| 6,407,339 | B1 | 6/2002 | Rice et al. | |
| 6,522,233 | B1 * | 2/2003 | Kyoso | H01F 27/306 336/192 |

(Continued)

OTHER PUBLICATIONS

Hayunga, CP; "Transformer", ip.com , https://priorart.ip.com/IPCOM/000091919, Jul. 1, 1968.

(Continued)

*Primary Examiner* — Ronald Hinson

(74) *Attorney, Agent, or Firm* — GE Global Patent Operation; Nitin N. Joshi

(57) ABSTRACT

A transformer includes a ceramic housing, a primary winding disposed within the housing, a secondary winding disposed outside the winding, and a core extending through a first aperture in the housing. The housing includes a first portion and a second portion. Each of the first and second portions include a planar structure having a first housing aperture, and a plurality of sidewalls extending perpendicular to the planar structure along a plurality of edges of the planar structure. The first and second portions interface with one another when the ceramic housing is assembled such that the sidewalls of the first and second portions overlap with one another.

17 Claims, 7 Drawing Sheets

(56) References Cited

U.S. PATENT DOCUMENTS

| | | | | |
|---|---|---|---|---|
| 2005/0007232 | A1* | 1/2005 | Ono | H01F 1/1475 336/213 |
| 2010/0079233 | A1* | 4/2010 | Koprivnak | H01F 27/2804 336/200 |
| 2014/0049349 | A1 | 2/2014 | McConkey | |
| 2015/0243429 | A1* | 8/2015 | Liao | H01F 27/027 333/167 |

OTHER PUBLICATIONS

Zickar, Frank R.; "Powder Coated Conductor for Transformer Windings", 14th Electrical/Electronics Insulation Conference, Oct. 8-11, 1979.

Vasic, Dejan, et al.; "A New Method to Design Piezoelectric Transformer Used in MOSFET and IGBT Gate Drive Circuits", IEEE 34th Annual Power Electronics Specialist Conference, Jun. 15-19, 2003.

Cioffi, P.M., et al., Insulation for Transformer or inductor, GE Co-Pending U.S. Appl. No. 15/402,980, filed Jan. 10, 2017.

* cited by examiner

CERAMIC INSULATED TRANSFORMER

STATEMENT REGARDING FEDERALLY SPONSORED RESEARCH & DEVELOPMENT

This invention was made with Government support under contract number DE-EE0007252 awarded by the Department of Energy. The Government has certain rights in the invention.

BACKGROUND

The subject matter disclosed herein relates to electrical components, and specifically to transformers.

Transformers typically include primary and secondary windings wrapped around a core. The primary winding is electrically coupled to an alternating current (AC) power source and the secondary winding is electrically coupled to a load. Based on a ratio of the number of turns in the primary winding to the number of turns in the secondary winding, the transformer may increase or decrease the voltage output by the AC power source.

In the design of transformers, it may be difficult to achieve sufficient strike distance (the shortest distance between two conductors through air) and creepage distance (the shortest distance between two conductors along a surface of an insulator) while maintaining a small form factor.

BRIEF DESCRIPTION

Certain embodiments commensurate in scope with the original claims are summarized below. These embodiments are not intended to limit the scope of the claims, but rather these embodiments are intended only to provide a brief summary of possible forms of the claimed subject matter. Indeed, the claims may encompass a variety of forms that may be similar to or different from the embodiments set forth below.

In one embodiment, a transformer includes a ceramic housing, a primary winding disposed within the housing, a secondary winding disposed outside the winding, and a core extending through a first aperture in the housing. The housing includes a first portion and a second portion. Each of the first and second portions include a planar structure having a first housing aperture, and a plurality of sidewalls extending perpendicular to the planar structure along a plurality of edges of the planar structure. The first and second portions interface with one another when the ceramic housing is assembled such that the sidewalls of the first and second portions overlap with one another.

In a second embodiment, a system includes an alternating current (AC) power source configured to output an AC signal, a transformer, and a load. The transformer includes a ceramic housing comprising a first portion and a second portion, a primary winding disposed within the ceramic housing and electrically coupled to the AC power source, a secondary winding disposed outside the ceramic housing, and a core extending through first housing apertures. Each of the first and second portions of the housing include a planar structure having the first housing aperture, and a plurality of sidewalls extending perpendicular to the planar structure along a plurality of edges of the planar structure. The first and second portions of the housing interface with one another when the ceramic housing is assembled such that the sidewalls of the first and second portions overlap with one another. The load is electrically coupled to the secondary winding. The transformer is configured to receive the AC signal from the AC power source, step up or step down a voltage of the AC signal, and output the stepped up or stepped down AC signal to the load.

In a third embodiment, a method of assembling a transformer includes disposing a primary winding on an interior surface of a first portion of a ceramic housing, such that a first winding aperture of the primary winding aligns with a first housing aperture of the first portion of the housing, disposing a second portion of the housing over the first portion of the ceramic housing such that an interior surface of the second portion of the housing faces an interior surface of the second portion of the housing, and one or more sidewalls of the first portion of the ceramic housing overlap with one or more sidewalls of the second portion of the ceramic housing, and coupling a first portion of a secondary winding to an exterior surface of the first portion of the housing.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

Transformers typically include primary and secondary windings wrapped around a core. Based on a ratio of the number of turns in the primary winding to the number of turns in the secondary winding, the transformer may increase or decrease a voltage of a signal received from an alternating current (AC) power source and providing power to a load. It may be difficult to design a transformer having sufficient strike distance (the shortest distance between two conductors through the air) and creepage distance (the shortest distance between two conductors along a surface of an insulator) while maintaining a small form factor. By enclosing the primary winding inside a ceramic housing and coupling the secondary winding to the exterior of the ceramic housing, a small form factor may be maintained while achieving sufficient strike distance and creep distance.

Figure 1:
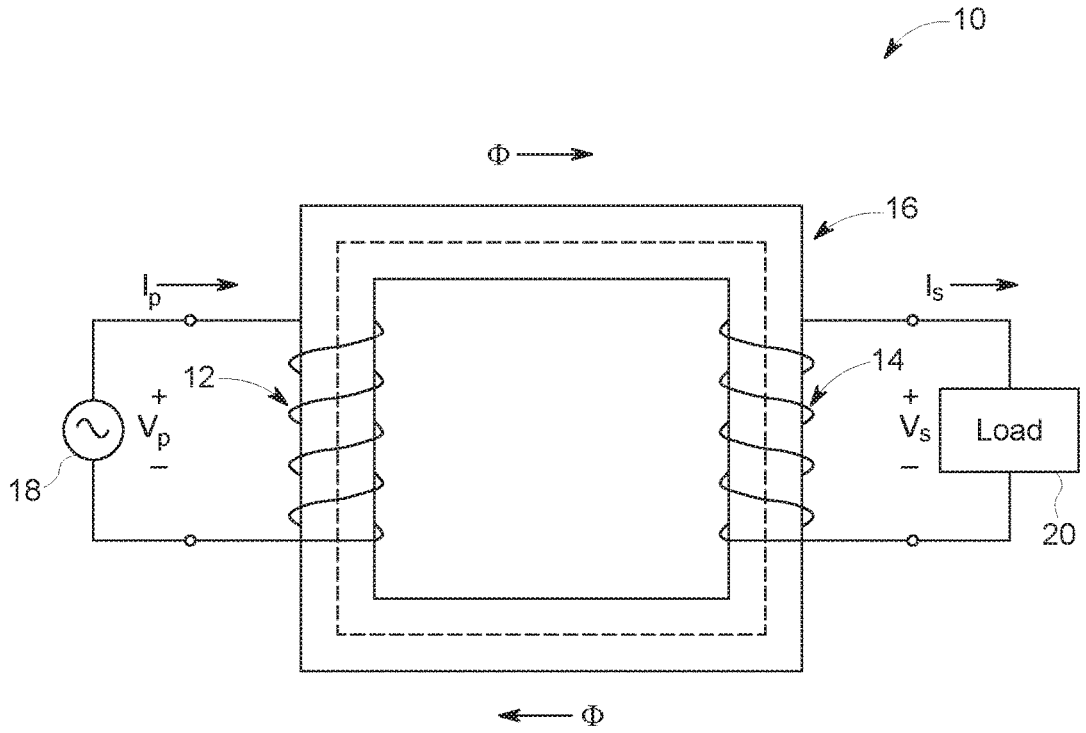
FIG. 1 PRIOR ART
FIG. 1 is a schematic of an exemplary transformer.

FIG. 1 is a schematic of an exemplary transformer 10. The transformer 10 includes a primary winding 12 and a secondary winding 14 wrapped around opposite sides of a magnetic core 16. The primary winding 12 is electrically coupled to an alternating current (AC) power source 18, which provides a varying primary current $I_P$ and a primary electromotive force (EMF) or voltage $V_P$ that flow through the primary winding 12 and around the core 16. The varying primary current $I_P$ flowing around the core 16 forms a varying magnetic flux $\phi$ in the core 16 and a varying magnetic field acting on the secondary winding 14. The varying magnetic field at the secondary winding 14 creates a varying secondary EMF or voltage $V_S$ in the secondary winding 14 via electromagnetic induction, causing a varying secondary current $I_S$ to flow to a load 20. The ratio of the primary voltage $V_P$ to the secondary voltage $V_S$ is equal to the ratio of the number of turns $N_P$ in the primary winding 12 to the number of turns $N_S$ in the secondary winding 14. Accordingly, transformers 10 in which the ratio of $N_P$ to $N_S$ is greater than 1 are referred to as step down transformers because $V_S$ is less than $V_P$. Correspondingly, transformers 10 in which the ratio of $N_P$ to $N_S$ is less than 1 are referred to as step up transformers because $V_S$ is greater than $V_P$. Thus, transformers 10 are commonly used in a vast number of electrical systems to step up or step down voltage in AC power signals. In application, transformers may range from a small component on a circuit board of an electrical consumer product to a multi-ton component in a utility company's power grid.

Two design considerations in transformers 10, and in electrical components in general, are strike distance (or clearance) and creepage distance. Strike distance is the shortest distance between two conductors (e.g., the first winding 12 and the second winding 14) through the air. If the strike distance between two conductors is not sufficient, if the air between the conductors becomes ionized, and/or the voltage difference between the conductors ($V_P$–$V_S$) becomes large enough, an arc may form through the air, creating a short between the two conductors. Creepage distance is the shortest distance between two conductors along a surface of an insulator. If the creepage distance between two conductors is insufficient, as the surface of the insulator degrades, it may become conductive, allowing electricity to travel across the surface of the conductor, and creating a short between the two conductors. For transformers 10 with small form factors, it can be difficult to design the transformer 10 with sufficient strike distance and creepage distance between the first winding 12 and the second winding 14. However, by using a clamshell-type ceramic housing to house the primary winding 12 and separate the primary winding 12 from the secondary winding 14, a transformer 10 with sufficient strike distance and creepage distance may be achieved while maintaining a small form factor.

Figure 2:
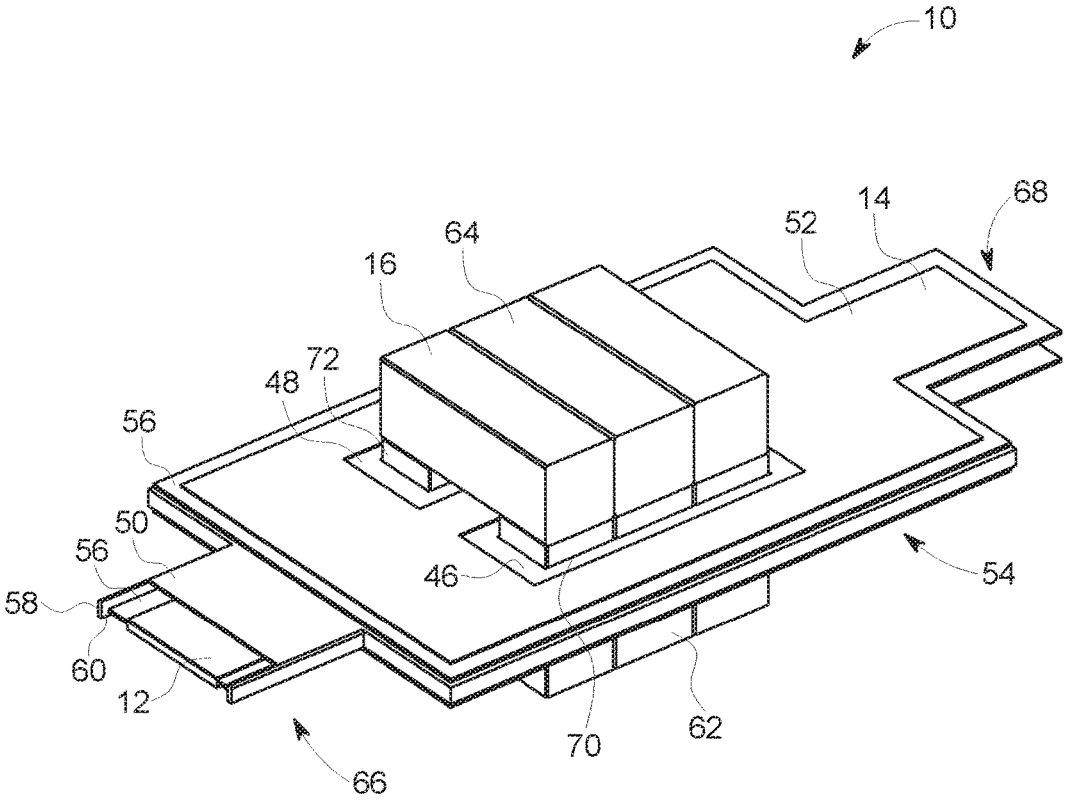
FIG. 2 is a perspective view of a transformer having a clamshell ceramic housing, in accordance with an embodiment.

FIG. 2 is a perspective view of a transformer 10 having a clamshell ceramic housing 50, in accordance with an embodiment. The primary winding 12 may be disposed within the housing 50 while the secondary winding 14 may be disposed outside of the housing 50. Specifically, the secondary winding may include a first portion 52 on one side of the housing 50, and a second portion 54 on an opposite side of the housing 50 (not visible in FIG. 2), which are electrically coupled to one another. As illustrated, the primary and secondary windings 12, 14 may be substantially planar in shape, each with two holes 46, 48 (e.g., winding apertures) through which either side of the core 16 passes. Though each of the windings 12, 14 is shown in FIG. 2 as being a plane of material, this is merely for the sake of simplicity and it should be understood that each winding 12, 14 may include windings of material rather than a sheet of material. Along these lines, windings 12, 14 may also be achieved by electrically connecting layers of material. The windings 12, 14 may be made of copper, copper alloys, or some other conductive material. In the illustrated embodiment, each of the windings 12, 14 (or winding portions 52, 54) is coupled to a circuit board 56. The circuit boards 56 may provide a support structure for the windings 12, 14, and may also facilitate electrical connections with the windings 12, 14. However, some embodiments may omit the circuit boards 56.

As will be shown and described in more detail below, the ceramic housing 50 may include a first portion 58 and a second portion 60. Each of the first portion 58 and the second portion 60 have a substantially planar structure with substantially perpendicular sidewalls, which overlap when the housing 50 is assembled and two housing holes 70, 72 through which either side of the core 16 passes. In the illustrated embodiment, the housing is made of aluminum oxide ($Al_2O_3$), otherwise known as alumina. Alumina's relatively high conductivity (approximately 30 W/mK) for an electrical insulator makes it well-suited for dissipating heat generated by the transformer 10, however, it should be understood that transformers 10 having housings 50 made of other materials are also envisaged.

The core 16 may include a first portion 62 and a second portion 64. The first portion 62 may be substantially "U" shaped and the second portion 64 may be generally "I" shaped. The core 16 may be divided into multiple portions 62, 64 to facilitate assembly of the transformer 10. For example, the first portion 62 may be inserted through the holes 70, 72 of the housing 50, and the holes 46, 48 of the primary winding 12, secondary winding 14, and the circuit boards 56 and then coupled to the second portion 64. It should be understood, however, that other configurations may be possible. For example, the core 16 may have two L-shaped portions. In some embodiments, the core 16 may be a single structure about which the rest of the transformer's 10 components are assembled. In the illustrated embodiment, the core 16 is made of ferrite, but cores made of other magnetic materials are also envisaged.

Once assembled, the AC power source 18 (see FIG. 1) may be electrically coupled to the primary winding 12 at a first end 66 of the transformer 10, and the load 20 (see FIG. 1) may be electrically coupled to the secondary winding 14 at a second end 68 of the transformer 10. Disposing the primary winding 12 within the ceramic housing 50 and the secondary winding 14 outside of the ceramic housing 50 achieves sufficient strike distance and creepage distance without sacrificing small form factor of the transformer 10.

Figure 3:
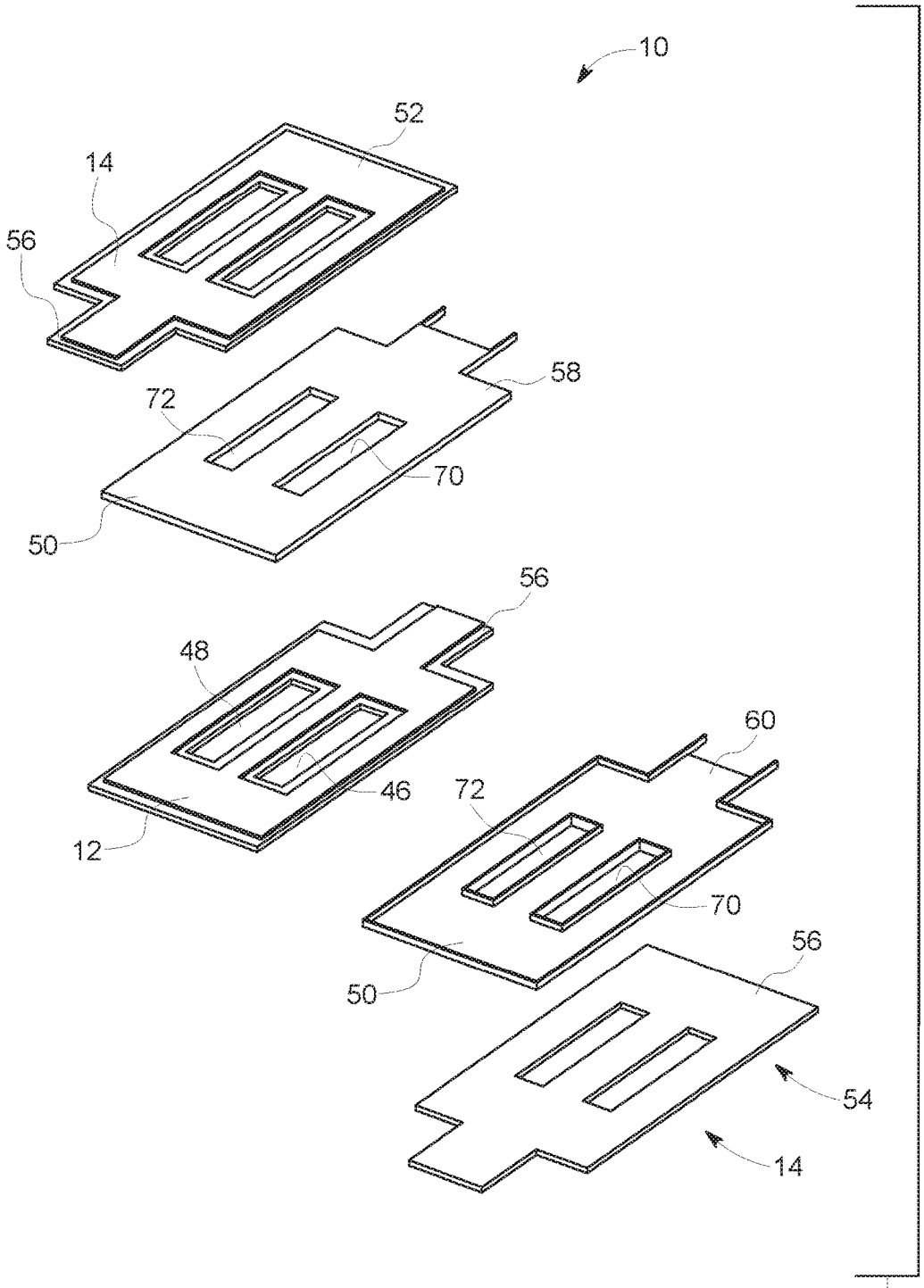
FIG. 3 is an exploded perspective view of a housing and windings of the transformer of FIG. 2, in accordance with an embodiment.

FIG. 3 is an exploded perspective view of the housing 50 and the windings 12, 14 of the transformer 10 shown in FIG. 2, in accordance with an embodiment. As described above, the primary winding 12 and circuit board 56 are enveloped by the first and second portions 58, 60 of the housing 50. The first and second portions 52, 54 of the secondary winding 14, and corresponding circuit boards 56 are disposed on either side of the exterior of the housing 50 (e.g., the first portion 52 of the secondary winding 14 is coupled to the first portion 58 of the housing 50, opposite the primary winding 12, and the second portion 54 of the secondary winding 14 is coupled to the second portion 60 of the housing 50, opposite the primary winding 12).

Figure 4:
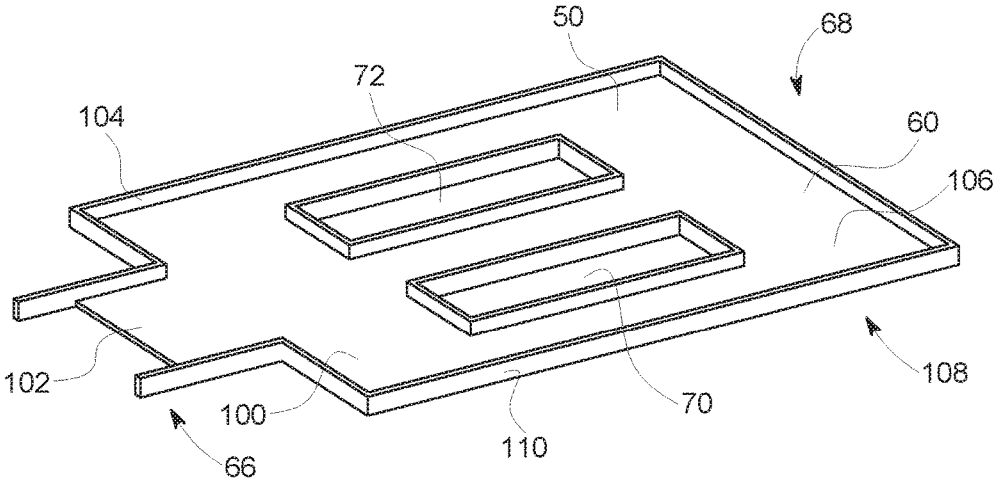
FIG. 4 is a perspective view of a second portion of the housing of FIG. 3, in accordance with an embodiment.

FIG. 4 is a perspective view of the second portion 60 of the housing. Though the first portion 58 of the housing 50 is not shown in detail, it should be understood that the first portion 58 and the second portion 60 have the same or substantially the same geometries. For example, one of the portions 58, 60 may be slightly wider than the other such that when the portions are mated to one another, their sidewalls overlap. As illustrated, the second portion includes a planar piece 100 of ceramic material having an interior surface 106, an exterior surface 108, and first and second holes 70, 72 through which the core extends. In the illustrated embodiment, the first and second holes 70, 72 are generally rectangular in shape and extend parallel to one another. However, other configurations of the first and second holes 70, 72 are envisaged. In some embodiments, the second portion 60 may include a protrusion 102 at the first end 66 of the second portion 60. A plurality of sidewalls 104 extending from the interior surface 106, perpendicular to the plane of material 100, along one or more edges 100 of the plane of material 100. In some embodiments, sidewalls 104 may extend up along all of the edges 110 of the plane of material 100, in other embodiments only some of the edges 110 may have sidewalls 104. As discussed above, it should be understood that, though not shown, the first portion 58 of the housing may have similar or the same geometry. The sidewalls may be configured such that when the first portion 58 is mating to the second portion 60, the sidewalls 104 of each portion overlap.

Figure 5:
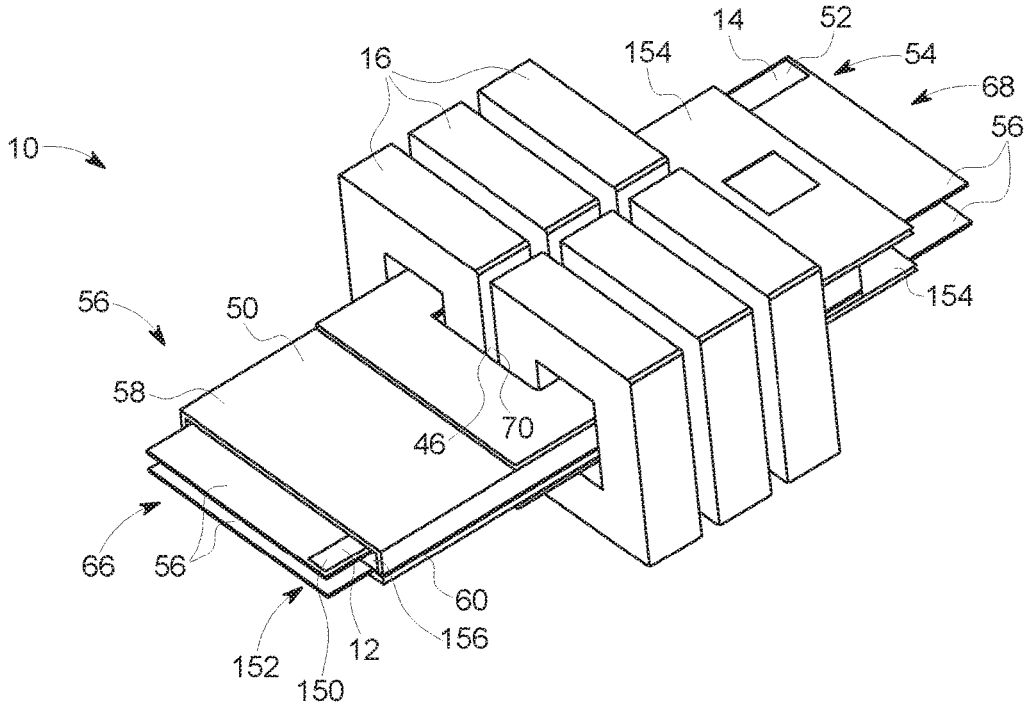
FIG. 5 is a perspective view of an embodiment of a transformer having a clamshell ceramic housing.

FIG. 5 is a perspective view of an alternate embodiment of the transformer 10 having a ceramic clamshell housing 50. The transformer 10 includes 6 generally O-shaped cores that extend through a single hole in the middle of the transformer (e.g., winding hole 46, housing hole 70). In the illustrated embodiment, the primary winding 12 is separated into a first portion 150 and a second portion 152, each coupled to a circuit board 56 and disposed within the housing 50 and electrically coupled to one another. As with the previously discussed embodiments, the secondary winding 14 is also separated into first and second portions 52, 54, which are electrically coupled to one another. The first and second portions 52, 54 of the secondary winding 14 are each coupled to a circuit board 56 and disposed on either side of the housing 50. A layer of kapton 154 may be disposed on either side of the first and second portions 52, 54 of the secondary winding 14 to provide additional installation. The interior of the housing 50 may be filled with epoxy an epoxy matrix 156. In some embodiments, the epoxy may be used to fill the interior of the housing and further insulate the primary winding 12. In some embodiments, the epoxy matrix 156 may support the first and second portions 150, 152 of the primary winding 12. In further embodiments, the epoxy matrix 156 may also function to hold the first and second portions 58, 60 of the housing 50 together. In some embodiments, the epoxy matrix 156 may also include one or more heat dissipation components (e.g., heat pipes, heat sinks, heat fins, etc.).

Figure 6:
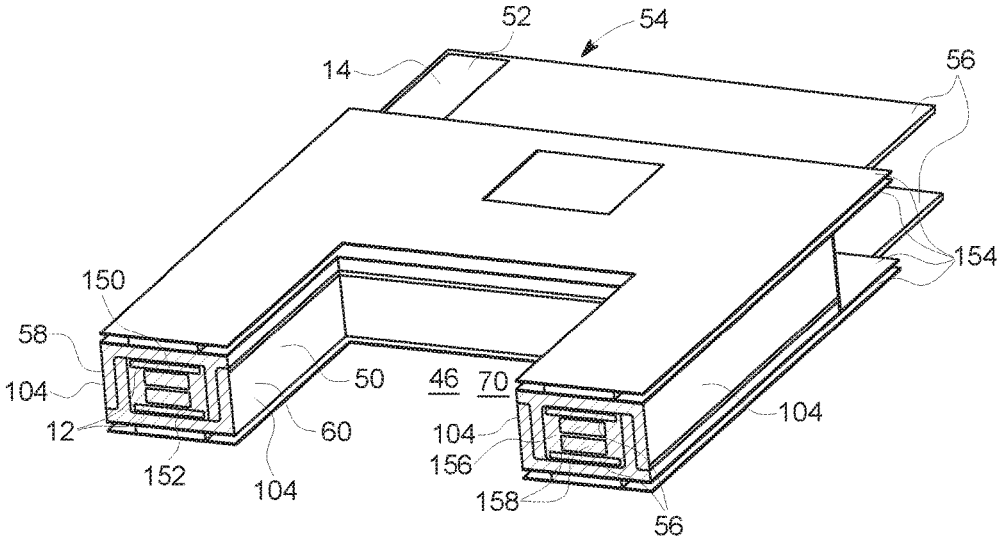
FIG. 6 is a perspective section view of the transformer having the clamshell ceramic housing of FIG. 5, in accordance with an embodiment.

FIG. 6 is a perspective section view of the transformer having the ceramic clamshell housing 50 of FIG. 5. As previously described, the first and second portions 52, 54 of the secondary winding 14 may be coupled to one or both sides of circuit boards 56 and disposed on either side of the housing 50, and circumnavigate the hole 70 in the housing 50 one or more times. Each portion 52, 54 of the secondary winding 14 may have a layer of kapton 154 disposed on one or both sides to insulate the secondary winding 14. Of course, the first and second portions 52, 54 of the secondary winding 14 are electrically coupled to one another. As shown, the clamshell housing 50 includes first and second portions 58, 60, each having sidewalls 104 that overlap when the housing 50 is assembled. The primary winding 12, which may be separated into one or more portions 150, 152 disposed on one or more circuit boards 56. In the illustrated embodiment, the first portion 150 of the primary winding 12 is disposed adjacent to the first portion 58 of the housing 50 and the second portion 152 of the primary winding 12 is disposed adjacent the second portion 60 of the housing 50. The epoxy matrix 156 may fill the interior volume of the housing 50. The epoxy matrix 156 may be used to insulate the primary winding 12, support the primary winding 12, hold the first and second portions 58, 60 of the housing 50 together, or some combination thereof. The epoxy matrix 156 may also include heat dissipation components. For example, in the illustrated embodiment, one or more heat pipes 158 extend through the epoxy matrix 156, between the first and second portions 150, 152 of the primary winding 12 to dissipate heat from the primary winding 12.

Figure 7:
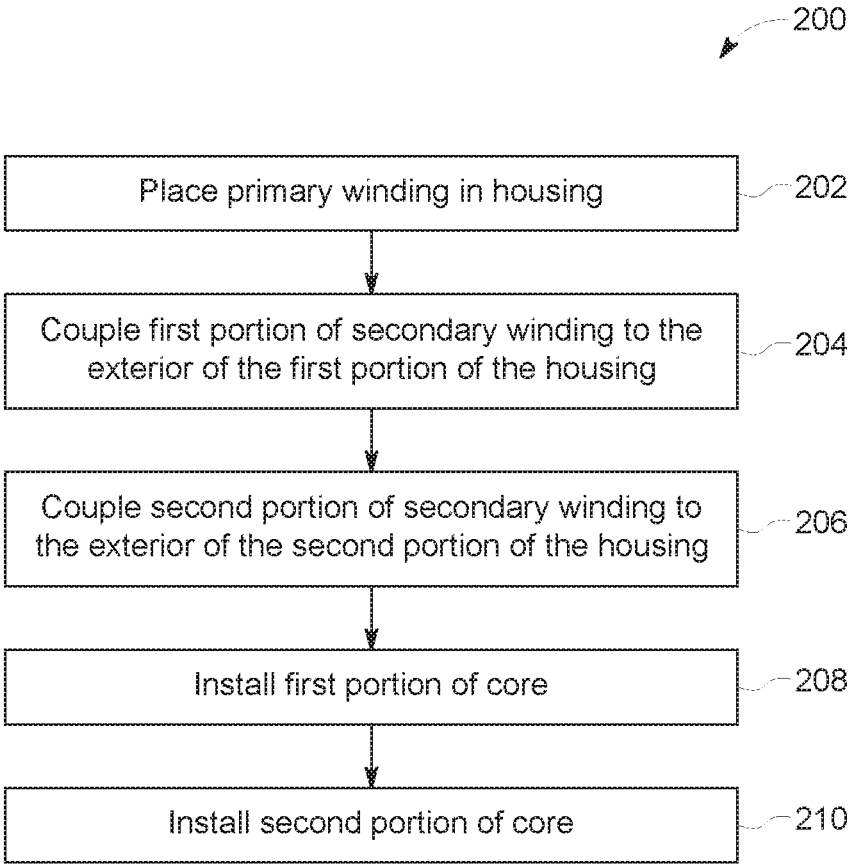
FIG. 7 is a flow chart of a process for assembling the transformer of FIG. 2, in accordance with an embodiment.

FIG. 7 is a flow chart of a process 200 for assembling the transformer 10. In block 202, the primary winding 12 is placed in the housing 50. The primary winding 12, which in some embodiments may be coupled to a circuit board 56, may be laid on or coupled to the interior surface 106 (e.g., within the sidewalls 104) of the first portion 58 of the housing 50 or the second portion 54 of the housing 50 such that the first and second holes 46, 48 in the primary winding 12 and the first and second holes 70, 72 of the first portion 58 of the housing 50 align with one another. The other portion of the housing 50 (e.g., the first portion 58 or the second portion 60) may be laid over the primary winding 12 such that the sidewalls 104 of the first and second portions 58, 60 overlap, enclosing the primary winding 12.

Though FIGS. 2-6 illustrated two embodiments of a transformer having a clamshell ceramic housing 50, it should be understood that the illustrated and described embodiments are merely examples of many possible envisaged embodiments. Accordingly, the disclosed embodiments are not intended to limit the scope of the claims.

FIG. 7 is a flow chart of a process 200 for assembling the transformer 10. In block 202, the primary winding 12 is placed in the housing 50. The primary winding 12, which in some embodiments may be coupled to a circuit board 56, may be laid on or coupled to the interior surface 106 (e.g., within the sidewalls 104) of the first portion 58 of the housing 50 or the second portion 54 of the housing 50 such that the first and second holes 46, 48 in the primary winding 12 and the first and second holes 70, 72 of the first portion 58 of the housing 50 align with one another. The other portion of the housing 50 (e.g., the first portion 58 or the second portion 60) may be laid over the primary winding 12 such that the sidewalls 104 of the first and second portions 58, 60 overlap, enclosing the primary winding 12.

In block 204, the first portion 52 of the secondary winding 14, which may be coupled to a circuit board 56, is coupled to the exterior surface 108 of the first portion 58 of the housing 50. In block 206, the second portion 54 of the secondary winding 14, which may be coupled to a circuit board 56, is coupled to the exterior surface 108 of the second portion 60 of the housing 50. It should be understood, however, that in some embodiments, the secondary winding 14 may include a single portion 52 coupled to the exterior surface 108 of either the first portion 58 or the second portion 60 of the housing 50.

In block 208, the first portion 62 of the core 16 may be installed such that the first portion 62 of the core 16 extends through the first and second holes 70, 72 of the housing 50 and the first and second holes 46, 48 of the primary winding 12. In block 210, the second portion 64 of the core 16 may be installed by coupling the second portion 64 of the core 16 to the first portion 62 of the core 16. The first portion 62 of the core 16 and the second portion 64 of the core 16 may be coupled to one another via bonding, an adhesive, welding, fusing, or by some other process.

The disclosed subject matter includes a transformer having a two-part ceramic housing that encloses a primary winding. A secondary winding is disposed outside housing, on one or both sides of the housing. In some embodiments, one or more of the windings may be coupled to a circuit board. A core may extend through holes in the windings and the housing. The transformer may be coupled to an AC power source that outputs an AC signal. The transformer may step up or step down the voltage of the AC signal before providing the signal to a load. By enclosing the primary windings inside the ceramic housing and coupling the secondary windings to the exterior of the ceramic housing, a small form factor may be maintained while achieving sufficient strike distance and creep distance.

This written description uses examples to disclose the subject matter, including the best mode, and also to enable any person skilled in the art to practice the disclosed techniques, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A transformer comprising;

a ceramic housing comprising a first portion and a second portion, wherein each of the first and second portions comprise;

a planar structure having a first housing aperture and a second housing aperture; and a plurality of sidewalls extending perpendicular to the planar structure along a plurality of edges of the planar structure;

wherein the first and second portions interface with one another when the ceramic housing is assembled such that the sidewalls of the first and second portions overlap with one another;

a primary winding disposed within the ceramic housing; a secondary winding disposed outside the ceramic housing;

and a core extending through the first housing apertures and the second housing apertures;

wherein the primary winding and the secondary winding comprise first and second winding apertures respectively that substantially align with the first housing apertures and the second housing apertures of the first and second portions of the ceramic housing.

2. The transformer of claim 1, wherein the ceramic housing comprises aluminum oxide.

3. The transformer of claim 1, wherein the primary winding is configured to be electrically coupled to an AC power source.

4. The transformer of claim 1, wherein the secondary winding is configured to be electrically coupled to a load.

5. The transformer of claim 1, wherein the primary and secondary windings comprise a substantially planar structure.

6. The transformer of claim 1, wherein the core is of "U" shape, "I" shape, "L" shape or "O" shape.

7. The transformer of claim 1, wherein the interior of ceramic housing is filled with an epoxy matrix.

8. The transformer of claim 7, wherein the epoxy matrix includes one or more heat dissipation components.

9. The transformer of claim 1, wherein the secondary winding comprises:

a first secondary winding portion disposed exterior to the first portion of the housing; and a second secondary winding portion disposed exterior to the second portion of the housing, and electrically coupled to the first secondary winding portion.

10. The transformer of claim 9, wherein each of the primary winding, the first secondary winding portion, and the second secondary winding portion are coupled to a circuit board.

11. The transformer of claim 10, wherein the primary winding and the circuit board it's coupled to are both enveloped by the first and second portions of the housing.

12. The transformer of claim 9, wherein a layer of kapton is disposed on either side of the first secondary winding portion, and the second secondary winding portion of the secondary winding.

13. A system, comprising;

an alternating current (AC) power source configured to output an AC signal; a transformer comprising:

a ceramic housing comprising a first portion and a second portion, wherein each of the first and second portions comprise:

a planar structure having a first housing aperture and a second housing aperture; and a plurality of sidewalls extending perpendicular to the planar structure along a plurality of edges of the planar structure;

wherein the first and second portions interface with one another when the ceramic housing Is assembled such that the sidewalls of the first and second portions overlap with one another;

a primary winding disposed within the ceramic housing and electrically coupled to the AC power source;

a secondary winding disposed outside the ceramic housing; and a core extending through the first housing apertures and the second housing apertures; and a load electrically coupled to the secondary winding; wherein the transformer is configured to:

receive the AC signal from the AC power source;

step up or step down a voltage of the AC signal; and output the stepped up or stepped down AC signal to the load;

wherein the primary winding and the secondary winding comprise first and second winding apertures respectively that substantially align with the first housing apertures and the second housing apertures of the first and second portions of the ceramic housing.

14. The system of claim 13, wherein the ceramic housing comprises aluminum oxide.

15. The system of claim 13, wherein the secondary winding comprises:

a first secondary winding portion disposed exterior to the first portion of the housing; and a second secondary winding portion disposed exterior to the second portion of the housing, and electrically coupled to the first secondary winding portion.

16. The system of claim 13, wherein each of the primary winding, the first secondary winding portion, and the second secondary winding portion are each coupled to a circuit board.

17. The system of claim 13, wherein the primary and secondary windings comprise a substantially planar structure.

* * * * *